US007524202B2

(12) United States Patent
Stepniak et al.

(10) Patent No.: US 7,524,202 B2
(45) Date of Patent: Apr. 28, 2009

(54) SEPARABLE ELECTRICAL CONNECTOR ASSEMBLY

(75) Inventors: Frank M. Stepniak, Cape May, NJ (US); Alan D. Borgstrom, Hackettstown, NJ (US); Larry N. Siebens, Ashbury, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/801,793

(22) Filed: May 10, 2007

(65) Prior Publication Data

US 2008/0045058 A1 Feb. 21, 2008

Related U.S. Application Data

(63) Continuation of application No. 11/386,625, filed on Mar. 22, 2006, now Pat. No. 7,216,426, which is a continuation of application No. 10/751,836, filed on Jan. 5, 2004, now Pat. No. 7,044,760, which is a continuation-in-part of application No. 10/186,843, filed on Jul. 1, 2002, now Pat. No. 6,939,151, which is a continuation-in-part of application No. 09/715,571, filed on Nov. 17, 2000, now Pat. No. 6,585,531, which is a continuation of application No. 09/287,915, filed on Apr. 7, 1999, now Pat. No. 6,168,447, which is a continuation-in-part of application No. 08/902,749, filed on Jul. 30, 1997, now Pat. No. 5,957,712.

(51) Int. Cl.
*H01R 13/53* (2006.01)

(52) U.S. Cl. ..... 439/187; 439/921

(58) Field of Classification Search ..... 439/187, 439/206, 921, 186, 181, 205; 29/564.1
See application file for complete search history.

(56) References Cited

U.S. PATENT DOCUMENTS

| | | | |
|---|---|---|---|
| 1,783,062 | A | 11/1930 | Trencham |
| 1,997,081 | A | 4/1935 | Reynolds |
| 2,002,177 | A | 5/1935 | Hastings |

(Continued)

OTHER PUBLICATIONS

"Safe-T-Ring™ an anti-vacuum device 9U02Ring", Internet Advertisement, Chardon Electrical Components, Greeneville, TN (1998).

(Continued)

*Primary Examiner*—Javaid Nasri
(74) *Attorney, Agent, or Firm*—Hoffmann & Baron, LLP

(57) ABSTRACT

A high voltage loadbreak bushing insert includes an insulative housing having a first end section, a second end section opposite the first end section, a mid-section disposed between the first and second end sections and a transition shoulder portion disposed between the second end section and the mid-section. The second end section is dimensioned for insertion into a power cable elbow connector and the mid-section is dimensioned to be sealed against an elbow cuff of the power cable elbow connector. The transition shoulder portion includes at least one raised portion protruding radially outwardly from the transition shoulder portion. The raised portion is adapted to force the elbow cuff of the power cable elbow connector to expand in a radially outward direction upon withdrawal of the second end section from the power cable elbow connector, thereby venting a cavity formed between the bushing insert and the power cable elbow connector.

14 Claims, 9 Drawing Sheets

U.S. PATENT DOCUMENTS

| | | | |
|---|---|---|---|
| 2,103,609 | A | 12/1937 | Bradburn |
| 2,555,047 | A | 5/1951 | Logue |
| 2,605,389 | A | 7/1952 | Kimball |
| 2,608,436 | A | 8/1952 | Baughman |
| 2,667,532 | A | 1/1954 | Ewer |
| 3,376,541 | A | 4/1968 | Link |
| 3,384,861 | A | 5/1968 | Phillips |
| 3,410,488 | A | 11/1968 | Sugimura |
| 3,474,386 | A | 10/1969 | Link |
| 3,509,518 | A | 4/1970 | Phillips |
| 3,513,425 | A | 5/1970 | Arndt |
| 3,652,975 | A | 3/1972 | Keto |
| 3,663,928 | A | 5/1972 | Keto |
| 3,670,287 | A | 6/1972 | Keto |
| 3,678,432 | A | 7/1972 | Boliver |
| 3,711,023 | A | 1/1973 | Smith |
| 3,713,077 | A | 1/1973 | Leonard |
| 3,720,904 | A | 3/1973 | De Sio |
| 3,736,505 | A | 5/1973 | Sankey |
| 3,753,203 | A | 8/1973 | Link |
| 3,793,614 | A | 2/1974 | Tachick et al. |
| 3,813,639 | A | 5/1974 | Schurter |
| 3,826,860 | A | 7/1974 | De Sio et al. |
| 3,836,439 | A | 9/1974 | Yonkers |
| 3,849,186 | A | 11/1974 | Tachick et al. |
| 3,860,322 | A | 1/1975 | Sankey et al. |
| 3,908,905 | A | 9/1975 | Von Phlipp et al. |
| 3,915,534 | A | 10/1975 | Yonkers |
| RE28,604 | E | 11/1975 | Kotski |
| 3,917,374 | A | 11/1975 | Murdock |
| 3,953,099 | A | 4/1976 | Wilson |
| 3,955,874 | A | 5/1976 | Boliver |
| 3,957,332 | A | 5/1976 | Lambert, III |
| 3,960,433 | A | 6/1976 | Boliver |
| 3,985,699 | A | 10/1976 | Schmid |
| T953,007 | I4 | 12/1976 | Tachick |
| 4,064,203 | A | 12/1977 | Cox |
| 4,067,636 | A | 1/1978 | Boliver et al. |
| 4,094,639 | A | 6/1978 | McMillan |
| 4,113,339 | A | 9/1978 | Eley |
| 4,123,131 | A | 10/1978 | Pearce, Jr. et al. |
| 4,159,860 | A | 7/1979 | Broad |
| 4,170,394 | A | 10/1979 | Conway |
| 4,175,815 | A | 11/1979 | Andersen et al. |
| 4,210,381 | A | 7/1980 | Borgstrom |
| 4,301,095 | A | 11/1981 | Mettler et al. |
| 4,353,611 | A | 10/1982 | Siebens et al. |
| 4,361,427 | A | 11/1982 | Barradas |
| 4,549,250 | A | 10/1985 | Spector |
| 4,570,824 | A | 2/1986 | Bolling |
| 4,603,030 | A | 7/1986 | McCarthy |
| 4,629,604 | A | 12/1986 | Spector |
| H280 | H | 6/1987 | Thigpen |
| 4,695,434 | A | 9/1987 | Spector |
| 4,714,984 | A | 12/1987 | Spector |
| 4,722,694 | A | 2/1988 | Makal et al. |
| 4,743,406 | A | 5/1988 | Steiner et al. |
| 4,808,347 | A | 2/1989 | Dawn |
| 4,863,392 | A | 9/1989 | Borgstrom et al. |
| 4,865,816 | A | 9/1989 | Walz et al. |
| 4,921,636 | A | 5/1990 | Traas |
| 5,023,020 | A | 6/1991 | Machida et al. |
| 5,034,222 | A | 7/1991 | Kellett et al. |
| 5,071,621 | A | 12/1991 | Tokuhiro et al. |
| 5,163,616 | A | 11/1992 | Bernarducci |
| 5,167,877 | A | 12/1992 | Pai |
| 5,178,327 | A | 1/1993 | Palamand et al. |
| 5,213,517 | A | 5/1993 | Kerek et al. |
| 5,220,636 | A | 6/1993 | Chang |
| 5,221,220 | A | 6/1993 | Roscizewski |
| 5,230,640 | A | 7/1993 | Tardif |
| 5,234,162 | A | 8/1993 | Sullivan |
| 5,248,263 | A | 9/1993 | Sakurai et al. |
| 5,266,041 | A | 11/1993 | De Luca |
| 5,269,723 | A | 12/1993 | Bender |
| 5,336,102 | A | 8/1994 | Cairns et al. |
| 5,342,584 | A | 8/1994 | Fritz et al. |
| 5,345,617 | A | 9/1994 | Jahner et al. |
| 5,356,304 | A | 10/1994 | Colleran |
| 5,358,420 | A | 10/1994 | Cairns et al. |
| 5,393,240 | A | 2/1995 | Makal et al. |
| 5,407,642 | A | 4/1995 | Lord |
| 5,433,622 | A | 7/1995 | Galambos |
| 5,478,505 | A | 12/1995 | McElfresh et al. |
| 5,492,487 | A | 2/1996 | Cairns et al. |
| 5,498,397 | A | 3/1996 | Horng |
| 5,527,493 | A | 6/1996 | McElfresh et al. |
| 5,556,287 | A | 9/1996 | Kuhn et al. |
| 5,564,951 | A | 10/1996 | Attal et al. |
| 5,565,148 | A | 10/1996 | Pendergrass, Jr. |
| 5,573,412 | A | 11/1996 | Anthony |
| 5,619,786 | A | 4/1997 | Baland |
| 5,624,230 | A | 4/1997 | Taylor et al. |
| 5,641,306 | A | 6/1997 | Stepniak |
| 5,655,921 | A | 8/1997 | Makal et al. |
| 5,658,387 | A | 8/1997 | Reardon et al. |
| 5,662,835 | A | 9/1997 | Collingwood |
| 5,706,569 | A | 1/1998 | Miyamoto et al. |
| 5,732,882 | A | 3/1998 | Gibbs |
| 5,735,918 | A | 4/1998 | Barradas |
| 5,752,658 | A | 5/1998 | Gibbs et al. |
| 5,765,595 | A | 6/1998 | Ballun |
| 5,769,274 | A | 6/1998 | Behar |
| 5,795,180 | A | 8/1998 | Siebens |
| 5,803,770 | A | 9/1998 | Swendson et al. |
| 5,805,768 | A | 9/1998 | Schwartz et al. |
| 5,816,835 | A | 10/1998 | Meszaros |
| 5,846,093 | A | 12/1998 | Muench, Jr. et al. |
| 5,857,862 | A | 1/1999 | Muench, Jr. et al. |
| 5,887,118 | A | 3/1999 | Huffman et al. |
| 5,899,382 | A | 5/1999 | Hayes et al. |
| 5,932,147 | A | 8/1999 | Chen |
| 5,935,526 | A | 8/1999 | Moore |
| 5,972,290 | A | 10/1999 | De Sousa |
| 6,013,524 | A | 1/2000 | Friars et al. |
| 6,024,783 | A | 2/2000 | Budman |
| 6,029,900 | A | 2/2000 | Quinones |
| 6,042,407 | A | 3/2000 | Scull et al. |
| 6,060,045 | A | 5/2000 | Mettler |
| 6,083,456 | A | 7/2000 | Van Rees |
| 6,099,137 | A | 8/2000 | McCormack et al. |
| 6,103,201 | A | 8/2000 | Green |
| 6,136,277 | A | 10/2000 | Nardini |
| 6,152,829 | A | 11/2000 | Jaidka |
| 6,179,219 | B1 | 1/2001 | Lin |
| 6,197,263 | B1 | 3/2001 | Blount |
| 6,213,799 | B1 | 4/2001 | Jazowski et al. |
| 6,231,404 | B1 | 5/2001 | Lichy |
| 6,254,823 | B1 | 7/2001 | Rees |
| 6,270,720 | B1 | 8/2001 | Mandish |
| 6,315,959 | B2 | 11/2001 | Mandish |
| 6,332,785 | B1 | 12/2001 | Muench, Jr. et al. |
| D459,950 | S | 7/2002 | Bush et al. |
| 6,435,419 | B1 | 8/2002 | Davis |
| D463,437 | S | 9/2002 | Bush et al. |
| 6,504,103 | B1 | 1/2003 | Meyer et al. |
| 6,514,467 | B1 | 2/2003 | Bulsink et al. |
| 6,602,475 | B1 | 8/2003 | Chiao |
| 2001/0048641 | A1 | 12/2001 | Kaslon |
| 2002/0048530 | A1 | 4/2002 | Wohrle |
| 2002/0066798 | A1 | 6/2002 | Laudamiei-Pellet |
| 2002/0066967 | A1 | 6/2002 | Bartsch et al. |

2002/0068009 A1 6/2002 Laudamiei-Pellet
2002/0068010 A1 6/2002 Laudamiei-Pellet

OTHER PUBLICATIONS

Stepniak, Frank, "Presentation to Subcommittee 10-50 During IEEE Power Engineering Society Insulated Conductors Commitee", (Apr. 1997).
IEEE Power Engineering Society Insulated Conductors Committee Meeting Minutes of Apr. 20-23, 1997.
IEEE Power Engineering Society Insulated Conductors Committee Meeting Minutes of Nov. 2-5, 1997.
Elastimold Product Bulletin, No. PB 400-10-19, dated Oct. 21, 1991.
BPAI Decision re: Patent Interference No. 105,087, Paper No. 75, dated May 12, 2004.
BPAI Judgement-Rule 662 re: Patent Interference No. 105,087, Paper No. 80, dated Jun. 15, 2004.
BPAI Decision re: Patent Interference No. 105,087, Paper No. 83, dated Aug. 25, 2004.
BPAI Decision re: Patent Interference No. 105,087, Paper No. 92, dated Feb. 10, 2005.
BPAI Order re: Patent Interference No. 105,087, Paper No. 97, dated Jul. 23, 2007.
Elastimold, New Dimension in Loadbreak, Section 410-50, Elastimold Division, Amerace Corporation, 1974.
"Qualitative Evaluation of 15-KV Loadbreak Designs" R.J. Stanger, Elastimold Division, Amerace Corporation, Aug. 16, 1973.
BPAI Order-Rule 641 re: Patent Interference No. 105,087, Paper No. 76, dated May 12, 2004.
BPAI Decision re: Patent Interference No. 105,087, Paper No. 79, dated Jun. 15, 2004.
BPAI Order re: Patent Interface No. 105,087, dated Apr. 24, 2007.
United States District Court for the Western District of Tennessee Order re: Civil Action No. 05-2267DP, dated Apr. 16, 2007.
United States District Court for the Western District of Tennessee Order re: Civil Action No. 05-2267, dated Apr. 16, 2007.
Jazowski Preliminary Motion 1, Filed Before the BPAI in Patent Interference No. 105,087, dated Aug. 9, 2003.
Jazowski Preliminary Motion 2, Filed Before the BPAI in Patent Interference No. 105,087, dated Aug. 9, 2003.
Stepniak Opposition 1, Filed Before the BPAI Interference No. 105,087, dated Oct. 4, 2003.
Stepniak Opposition 2, Filed Before the BPAI Interference No. 105,087, dated Oct. 4, 2003.
Jazowski Reply 1, Filed Before the BPAI Interference No. 105,087, dated Oct. 31, 2003.
Jazowski Reply 2, Filed Before the BPAI Interference No. 105,087, dated Oct. 31, 2003.
Jazowski Request for Reconsideration, Filed Before the BPAI in Interference No. 105,087, dated Jun. 29, 2004.
Stepniak Opposition to Jazowski Request for Reconsideration, Filed Before the BPAI in Interference No. 105,087, dated Jun. 13, 2004.
Stepniak Request for Reconsideration, Filed Before the BPAI in Interference No. 105,087, dated Sep. 27, 2004.
Jazowski Opposition to Request for Reconsideration, Filed Before the BPAI in Interference No. 105,087, dated Oct. 12, 2004.
Jazowski Motion for Ruling on the Admissability of Evidence 3, Filed Before the BPAI in Interference No. 105,087, dated Oct. 12, 2004.
Jazowski Objection to Admissability of Evidence 3, Filed Before the BPAI in Interference No. 105,087, dated Oct. 1, 2004.
Stepniak, Frank M., "Effects of Partial Vacuum on 35kV Separable Connector Switching Performance," dated Sep. 16, 1996.
Makal, John, "Low Current Switching Phenomena," dated Sep. 16, 2006.
IEEE Power Engineering Society Insulated Conductors Committee Minutes of the 92nd Meeting, Nov. 8-11, 1992.
Cooper Power Systems—Loadbreak Apparatus Connectors—200A 25kV Class Loadbreak Bushing Insert Product Description, dated Jan. 1997 (Jazowski Exhibit 1015).
IEEE Power Engineering Society Insulated Conductors Committee Minutes of the 100th Meeting, Nov. 3-6, 1996.
Cooper Power Systems—Loadbreak Apparatus Connectors—200A 15kV Class Loadbreak Bushing Insert Product Description, dated Nov. 1995.
IEEE Power Engineering Society Conductors Committee Minutes of the 95th Meeting, May 22-25, 1994.
IEEE Power Engineering Society Insulated Conductors Committee Minutes of the 85th Meeting, Nov. 5-8, 1989.
IEEE Power Engineering Society Insulated Conductors Committee Minutes of the 84th Meeting, Apr. 23-26, 1989.

SEPARABLE ELECTRICAL CONNECTOR ASSEMBLY

CROSS-REFERENCE TO RELATED U.S. APPLICATIONS

This application is a continuation of U.S. application Ser. No. 11/386,625, filed Mar. 22, 2006, now U.S. Pat. No. 7,216,426, which is a continuation of U.S. application Ser. No. 10/751,836, filed Jan. 5, 2004, now U.S. Pat. No. 7,044,760, which is a continuation-in-part of U.S. application Ser. No. 10/186,843, filed on Jul. 1, 2002, now U.S. Pat. No. 6,939,151, which is a continuation-in-part of U.S. application Ser. No. 09/715,571, filed on Nov. 17, 2000, now U.S. Pat. No. 6,585,531, which is a continuation of U.S. application Ser. No. 09/287,915, filed on Apr. 7, 1999, now U.S. Pat. No. 6,168,447, which is a continuation-in-part of Ser. No. 08/902,749, filed on Jul. 30, 1997, now U.S. Pat. No. 5,957,712.

BACKGROUND OF THE INVENTION

1. Field of the Invention

The present invention relates to separable electrical connectors and more particularly to improvements in manufacturing separable electrical connectors, such as loadbreak connectors and deadbreak connectors, wherein a sleeve of low coefficient of friction material is provided during a molding process to protect the critical electrical interfaces of the connector from contamination. The sleeve further provides for ease of connection and disconnection of the resulting molded connector.

2. Description of the Prior Art

Loadbreak connectors used in conjunction with 15 and 25 KV switchgear generally include a power cable elbow connector having one end adapted for receiving a power cable and another end adapted for receiving a loadbreak bushing insert. The end adapted for receiving the bushing insert generally includes an elbow cuff for providing an interference fit with a molded flange on the bushing insert. This interference fit between the elbow cuff and the bushing insert provides a moisture and dust seal therebetween. An indicator band may be provided on a portion of the loadbreak bushing insert so that an inspector can quickly visually determine proper assembly of the elbow cuff and the bushing insert.

The elbow cuff forms a cavity having a volume of air which is expelled upon insertion of the bushing insert. During initial movement of the loadbreak connectors in the disassembly operation, the volume of air in the elbow cavity increases but is sealed off at the elbow cuff resulting in a decrease in pressure within the cavity. The dielectric strength of the air in the cavity decreases with the decrease in air pressure. Although this is a transient condition, it occurs at a critical point in the disassembly operation and can result in dielectric breakdown of the opening interface causing a flashover or arc to ground. The occurrence of flashover is also related to other parameters such as ambient temperature, the time relationship between the physical separation of the connectors and the sinusoidal voltage through the loadbreak connectors.

Another reason for flashover while switching loadbreak connectors, prior to contact separation, is attributed to a decrease in dielectric strength of the air along the interface between the bushing insert and the power cable elbow to ground. As earlier described, a decrease in air pressure is momentarily formed by the sealed cavity between the elbow cuff and the bushing insert flange. The lower pressure in the cavity reduces the dielectric strength of the air along the connection interface possibly resulting in flashover.

One drawback with loadbreak connectors of the prior art is the difficulty involved in inserting one end of the loadbreak bushing insert into the power elbow connector and inserting the opposite end of the loadbreak bushing insert into a bushing well. In particular, because the interface surfaces of the loadbreak bushing insert and the power elbow connector and the bushing well are typically made from a rubber material, the frictional forces engaged in inserting the loadbreak bushing insert are substantial, even when lubricated. In other words, the rubber to rubber surfaces typically stick together upon assembly of the loadbreak connector.

Other drawbacks with these type of connectors relate to the problems encountered during manufacturing. Typically, these connectors are made by injection molding of a rubber or an epoxy material wherein the critical electrical interfaces are formed by molding the material against a metal mold surface. To prevent the material from sticking to the mold surface, release agents are typically sprayed in the mold cavities. Once cured, the connector is removed from the mold and, due to the nature of the molding material, a considerable amount of mold flashing must be trimmed. Even when trimmed properly, mold parting lines on the connector interface surfaces may disrupt the required connector seal and result in an electrical short. Also, the mold cavities are typically prone to contaminants, which may in turn be imparted onto the electrical interface of the connector resulting in a scrapped part.

Accordingly, it would be advantageous to provide a method for manufacturing a molded electrical connector which reduces or prevents the aforesaid manufacturing problems. It would also be desirable to provide a separable electrical connector system which is easily assembled and disassembled with a mating connector and is quickly visually inspected to determine proper assembly. It would further be advantageous to provide such a system with a visible identification of the operating voltage class of the connectors.

OBJECTS AND SUMMARY OF THE INVENTION

It is an object of the invention to provide separable electrical connectors, which upon disassembly under load, prevent flashover from occurring at the interface of the connectors.

It is a further object of the invention to provide a separable electrical connector, such as a power cable elbow connector and loadbreak bushing insert, having a modified interface which is vented to prevent a decrease in air pressure therebetween and a resulting decrease in dielectric strength of the air causing a flashover.

It is still a further object of the invention to provide a power cable elbow connector and loadbreak bushing insert having an indicator band formed on the bushing insert and which is vented to prevent a decrease in air pressure therebetween and a resulting decrease in dielectric strength of the air causing a flashover.

It is still a further object of the present invention to provide a separable electrical connector, such as a loadbreak bushing insert, with a plastic shell disposed on an interface surface thereof to reduce friction upon insertion of the loadbreak bushing insert into a power cable elbow connector.

It is still a further object of the present invention to provide a bushing well with a plastic shell disposed on an interface surface thereof to reduce friction upon insertion of a loadbreak bushing insert therein.

It is yet another object of the present invention to provide a power cable elbow connector and a loadbreak bushing insert in which the distance from the energized electrode of the elbow to the ground electrode of the bushing insert is increased to avoid flashover.

It is still a further object of the present invention to provide a power cable elbow connector having an electrode or probe in which a portion of the electrode is covered with an insulating material to increase the flashover distance to ground.

It is yet another object of the present invention to provide a power cable elbow connector in which the bushing insert receiving opening includes, at its upper end, an insulating material positioned within the conductive insert portion of the elbow connector to thereby increase the distance between an energized electrode and ground.

It is still another object of the present invention to provide an improved method of manufacturing a separable electrical connector which reduces the possibility of contaminants and irregularities on the critical electrical interfaces of the connector and which further reduces mold tool wear and cleaning.

In accordance with one form of the present invention, a loadbreak connector assembly includes a power cable elbow having a conductor receiving end and a loadbreak bushing insert insertion end and a loadbreak bushing insert. The loadbreak bushing insert includes an insulative outer housing having an axial bore therethrough, a conductive member positioned within the axial bore of the housing and wherein the outer housing is formed in three sections. The first end section is dimensioned to be seated in a universal bushing well, a second end section is dimensioned for insertion into the power cable elbow connector and the third section is a mid-section which is radially larger than the first and second end sections. The mid-section preferably includes a conductive portion for attachment of a ground conductor and a transition shoulder portion between the second end section and the mid-section. In order to prevent a pressure drop in a cavity formed between an elbow cuff of the elbow connector and the mid-section of the bushing insert, the transition shoulder portion of the bushing insert includes means for venting an annular top surface of the transition shoulder portion with the longitudinal side surface of the housing mid-section.

The venting means may be formed in a number of different ways including at least one vent groove formed in the transition shoulder portion of the outer housing, at least one through hole from the annular top surface to the longitudinal side surface, a circumferential groove formed in a transition shoulder portion, or a plurality of ribs circumferentially spaced along the transition shoulder portion of the outer housing. Furthermore, the cavity formed between the elbow cuff and bushing insert transition shoulder portion may include an elastomeric flap which fills the cavity therebetween preventing any pressure drop in the cavity.

In one embodiment, the venting means is included on an elbow seating indicator band formed on the transition shoulder portion of the bushing insert. Upon proper mating of the elbow to the loadbreak bushing, the indicator band is completely hidden from view under the elbow cuff. The transition shoulder portion is formed with a step or recess and the indicator band, molded or extruded of a contrasting bright color is placed in the step or recess. Thus, the band serves the dual purpose of indicating proper assembly of the elbow cuff and the bushing insert while also providing venting for the cavity formed therebetween.

In another embodiment, a separable electrical connector, such as a loadbreak bushing insert or a deadbreak plug, includes an interface shell molded from a low coefficient of friction plastic and having a sleeve portion provided on at least a substantial portion of the second end section of the housing for reducing frictional forces between the interface surfaces of mating connectors upon connection and disconnection therebetween. Preferably, the interface shell is molded from a different colored material than that of the housing, wherein the contrasting colored shell provides visual indication of proper assembly of the connector and can also represent the operating voltage class of the connector.

The interface shell further preferably includes a band portion being provided on the mid-section, adjacent the second end section of the housing, similar to the indicator band described above. The band portion can have a first color different than that of the housing, to provide visual indication of proper assembly of the connector, and the sleeve portion can have a second color different than that of the housing and the band portion, to represent the operating voltage class of a loadbreak bushing insert. The band portion of the interface shell is preferably integral with the sleeve portion and preferably includes at least one vent for venting a cavity formed between the bushing insert and a power cable elbow connector upon disconnection therebetween. Upon disconnection of the power cable elbow connector from the loadbreak bushing insert, the cavity is exposed to ambient air pressure via the vent thereby substantially preventing formation of a vacuum within the cavity. Thus, upon disassembly, a pressure decrease within the cavity is substantially prevented to reduce the possibility of flashover.

In a preferred method for forming a separable electrical connector, such as a loadbreak bushing insert, an interface shell is first molded from a low coefficient of friction plastic. The shell has an inner surface and a sleeve portion being dimensioned for insertion into a mating connector, such as a power cable elbow connector. An insulative housing is then molded within the interface shell whereby the housing is bonded to the inner surface of the shell. The insulative housing has a first end section extending outside of the shell and being dimensioned to be sealed in a bushing well, a second end section being molded within the sleeve portion of the shell and a mid-section being radially larger than the first and second end sections.

In an alternative method for forming a separable electrical connector, such as a loadbreak bushing insert, an insulative housing is formed having an axial bore therethrough. The housing includes a first end section being dimensioned to be sealed in a bushing well, a second end section being dimensioned for insertion into a mating connector, such as a power cable elbow connector and a mid-section being radially larger than the first and second end sections. An interface shell is separately molded from a low coefficient of friction plastic. The shell has a sleeve portion being dimensioned to be fitted over at least a substantial portion of the second end section of the housing. The interface shell is then bonded over at least a substantial portion of the second end section of the housing.

In yet another embodiment, a universal bushing well is provided having a low coefficient of friction plastic material shell disposed therein. The universal loadbreak bushing well includes a well housing having an interior surface defining an open chamber for receiving therein an end section of a loadbreak bushing insert. The bushing well interface shell is provided on the interior surface of the well housing for reducing frictional forces between the loadbreak bushing insert and the bushing well upon insertion of the insert into the well.

In combination, the present invention includes a first connector, such as a power cable elbow connector, a second connector, such as a loadbreak bushing insert having an interface shell molded from a low coefficient of friction plastic and a receptacle, such as a loadbreak bushing well. The power cable elbow connector includes a conductor receiving end, a loadbreak bushing insert receiving end and a conductive member extending from the cable receiving end to the bushing insert receiving end. The bushing insert receiving end includes an open end portion having an elbow cuff therearound. The loadbreak bushing insert includes an insulative housing having an axial bore therethrough and a conductive member positioned within the axial bore. The housing includes a first end section being dimensioned to be sealed in the bushing well, a second end section being dimensioned for insertion into the open end portion of the bushing insert receiving end of the power cable elbow connector and a mid-section being radially larger than the first and second end sections. The interface shell has a sleeve portion provided on at least a substantial portion of the second end section of the housing for reducing frictional forces between the loadbreak bushing insert and the power cable elbow connector upon connection and disconnection therebetween.

The bushing well includes a well housing having an interior surface defining an open chamber for receiving therein the first end section of the loadbreak bushing insert. In a preferred embodiment, the loadbreak bushing well further includes a bushing well interface shell provided on the interior surface of the well housing for reducing frictional forces between the loadbreak bushing insert and the bushing well upon insertion of the insert into the well.

Alternatively, the combination of a power cable elbow and loadbreak bushing insert may include a means for increasing the distance from an energized electrode to ground in order to prevent flashover during disassembly operation. The power cable elbow connector includes a conductor receiving end, loadbreak bushing insert receiving end and a conductive member extending from the cable receiving end to the bushing insert receiving end. The bushing insert receiving end includes an open end portion having an elbow cuff therearound. The loadbreak bushing insert includes an insulative outer housing having an axial bore therethrough and a conductive member positioned within the axial bore. The outer housing includes a power cable elbow insertion end and a mid-section dimensionally radially larger than the power cable elbow insertion end of the outer housing. The outer housing includes a transition shoulder portion between the mid-section and elbow insertion end for providing an interference-fit sealing relationship with the elbow cuff upon insertion of the bushing insert into the power cable elbow. The transition shoulder portion of the bushing insert includes vent means in accordance with the present invention for providing fluid communication between a cavity defined by the elbow cuff and the transition shoulder portion of the bushing insert upon disassembly therebetween and a location outside the mating elbow cuff and transition shoulder portion to prevent a pressure decrease within the cavity and flashover due to a decrease in dielectric strength of the air therein.

The mid-section of the bushing insert includes a conductive portion having least one ground connection terminal thereon for attachment of a ground conductor. In accordance with the present invention, the conductive portion is partially coated with an insulative material between the ground connection terminal and the transition shoulder portion thereby increasing the distance an arc from an energized electrode must travel to ground. Alternatively, the power cable elbow includes a probe or electrode for electrically contacting the conductive member of the bushing insert upon assembly. The probe includes a portion thereof having an insulative material surrounding the probe which extends into the bushing insert upon assembly of the power cable elbow and bushing insert. Accordingly, the distance an arc must travel from the energized electrode to ground is increased by the length of the insulative material surrounding the probe. Furthermore, the power cable elbow includes a conductive insert at the upper end of the bushing insert receiving space. The conductive insert may include insulative material at the upper portion of the bushing insert receiving space to provide an increased distance between an energized electrode and ground.

The present invention further involves a method for forming a separable electrical connector having an electrical interface surface. The method generally includes the steps of molding an interface shell from a thermoplastic, placing the interface shell against an electrical interface portion of a mold cavity and molding a housing within the mold cavity. When placed in the mold cavity, the interface shell provides a barrier to the mold cavity interface portion, wherein the housing is isolated from the electrical interface potion of the mold cavity by the interface shell. The shell has an inner surface and an outer surface and the housing is bonded to one of the inner and outer surfaces, wherein the other of the inner and outer surfaces of the shell defines the electrical interface surface of the electrical connector.

Preferably, placing the interface shell within the housing mold provides one or more of the following benefits during molding of the housing. The shell provides a barrier against contamination of the housing. The shell provides a barrier against the formation of mold parting lines in the housing. The shell provides a barrier against the formation of mold flashing on the housing and the shell provides a barrier against the formation of surface disruptions on said housing.

A separable electrical connector formed in accordance with the preferred method includes an insulative housing having an interface section being dimensioned to be sealed in a mating connector and an interface shell molded from a thermoplastic and having a sleeve portion provided on at least a substantial portion of the interface section of the housing. The sleeve portion defines an electrical interface surface for interfacing with the mating connector.

A preferred form of the separable electrical connectors including a power cable elbow connector, a loadbreak bushing insert, a seating indicator band, a bushing insert interface shell and a bushing well interface shell, as well as other embodiments, objects, features and advantages of this invention, will be apparent from the following detailed description of illustrative embodiments thereof, which is to be read in conjunction with the accompanying drawings.

DETAILED DESCRIPTION OF ILLUSTRATIVE EMBODIMENTS

Figure 1:
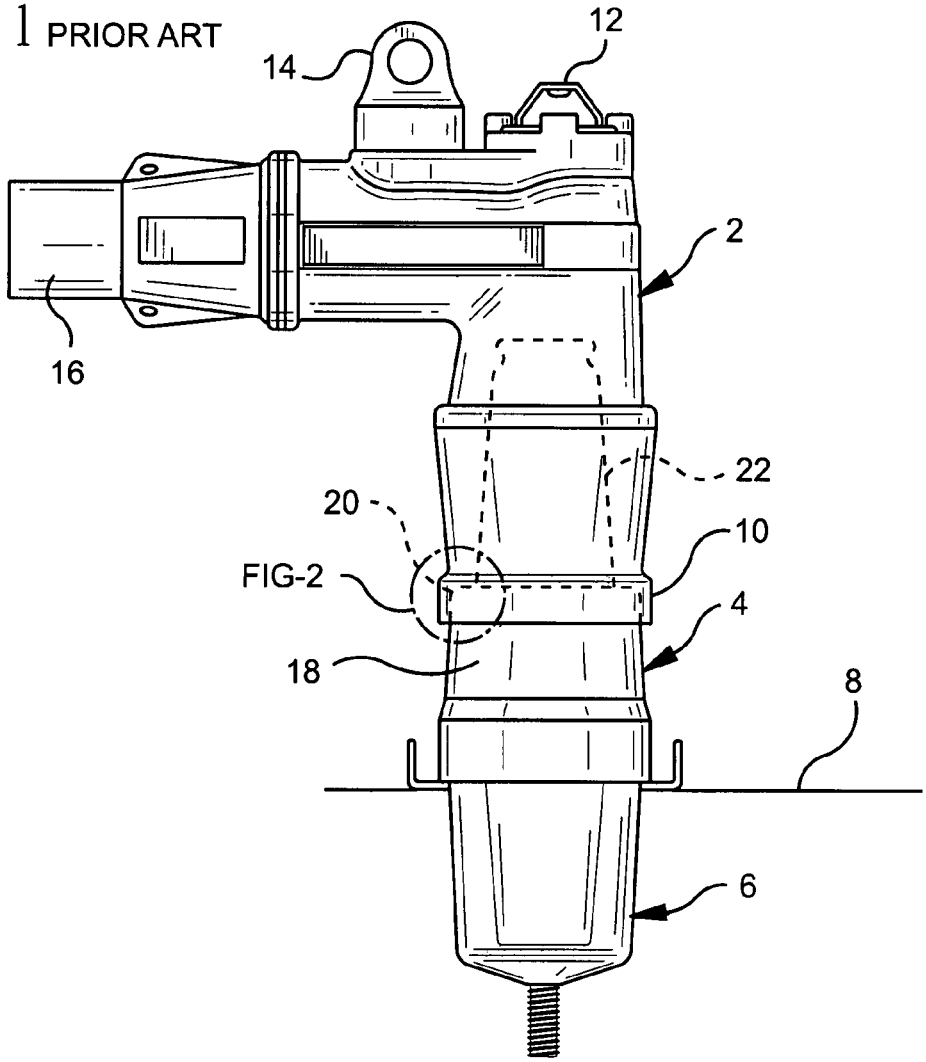
FIG. 1 PRIOR ART
FIG. 1 is a side elevation view of prior art loadbreak connectors, namely, a power cable elbow, a loadbreak bushing insert and a universal bushing well.
Figure 2:
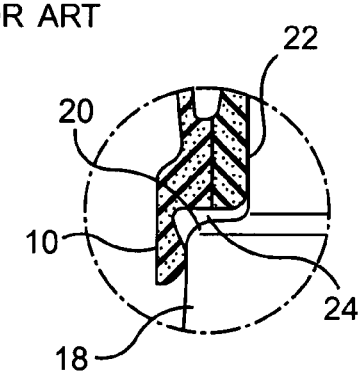
FIG. 2 PRIOR ART
FIG. 2 is an enlarged cross-sectional view of the mating interface between the prior art power cable elbow and loadbreak bushing insert illustrated in FIG. 1.

Referring to FIGS. 1 and 2, prior art loadbreak connectors are illustrated. In FIG. 1, a power cable elbow connector 2 is illustrated coupled to a loadbreak bushing insert 4 which is seated in a universal bushing well 6. The bushing well 6 is seated on an apparatus face plate 8. The power cable elbow connector 2 includes a first end adapted for receiving a loadbreak bushing insert 4 and having a flange or elbow cuff 10 surrounding the open receiving end thereof. The power cable elbow connector also includes an opening eye 12 for providing hot-stick operation and a test point 14 which is a capacitively coupled terminal used with appropriate voltage sensing devices. A power cable receiving end 16 is provided at the opposite end of the power cable elbow connector and a conductive member extends from the receiving end to the bushing insert receiving end for connection to a probe insertion end of the bushing insert.

Referring still to FIGS. 1 and 2, the loadbreak bushing insert includes a mid-section 18 having a larger dimension than the remainder of the bushing insert. The mid-section 18 includes a transition shoulder portion 20 between the mid-section and an upper section 22 which is inserted into the power cable elbow connector 2. As more clearly illustrated in FIG. 2, which is an enlarged cross-section of the connector interface, the elbow cuff 10 and side portion of the mid-section for the bushing insert provides a moisture and dust seal through an interference fit therebetween. Upon initial movement of the power cable elbow connector away from the bushing insert during a disassembly operation, a cavity 24 defined by the elbow cuff 10 and transition shoulder portion 20 of the bushing insert increases in volume. Due to the seal between the elbow cuff and the transition portion of the bushing insert, a decrease in pressure within the cavity 24 is created. The dielectric strength of the air in the cavity 24 decreases with the decrease in pressure. Although this is a transient condition, this decrease in dielectric strength occurs at a critical point in operation which may result in dielectric breakdown at the opening interface between the power cable elbow connector and the bushing insert causing a flashover, i.e. an arc to ground. The occurrence of such a flashover is also related to uncontrollable parameters such as ambient air temperature, the time relationship between the physical separation of the connectors and voltage.

In order to prevent flashover due to the decrease in dielectric strength of the air upon disconnecting the power cable elbow connector from a bushing insert under load, the present invention provides structure for either venting the cavity 24 created by the elbow cuff and bushing insert mid-section or, alternatively, increasing the distance between the energized electrode and ground thereby compensating for the reduced dielectric strength of the air at reduced pressure.

Referring now to FIGS. 3-10, the present invention provides for a means for venting the cavity defined by the power cable elbow cuff 10 and the bushing insert interface. More specifically, the vent means is provided such that when the power cable elbow connector is fully seated on the bushing insert, the elbow cuff provides a seal with the bushing insert mid-section 18. Upon disassembly and movement of the power cable elbow connector away from the bushing insert, the vent means is exposed, vents the cavity and equalizes the pressure in the cavity with the surrounding air pressure.

Figure 3:
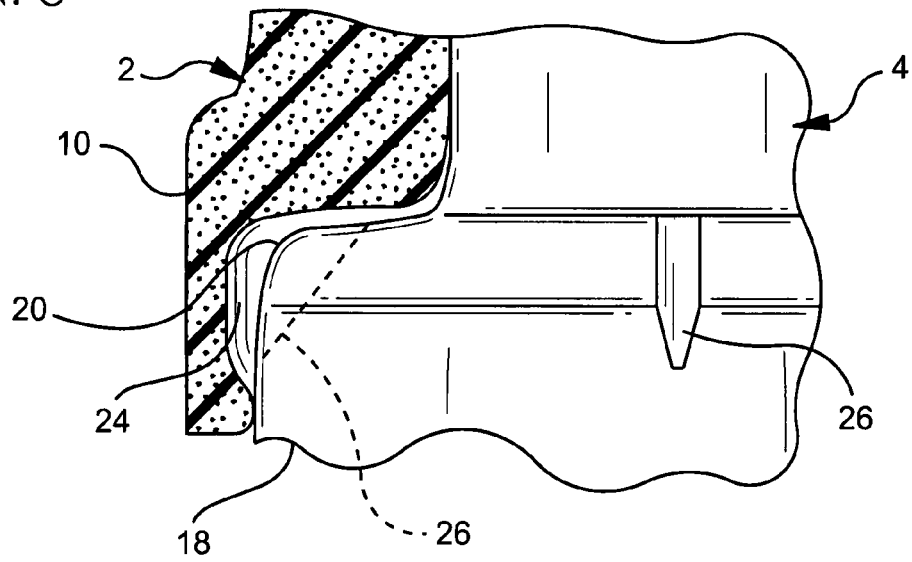
FIG. 3 is an enlarged cross-sectional view of the mating interface between the power cable elbow connector and a modified loadbreak bushing insert including vent grooves formed in accordance with the present invention.

Referring specifically to FIG. 3, which is a partial cross-sectional view illustrating the elbow cuff 10 and bushing insert interface, the transition shoulder portion 20 of the bushing insert is illustrated to include at least one vent groove 26 comprising an inclined cut-out portion of the bushing insert mid-section. Upon movement of the elbow cuff 10 away from the bushing insert during disassembly, the lower portion of the vent groove 26 is exposed to ambient air pressure creating fluid communication with the cavity 24 and equalizing the pressure within the cavity with that of the ambient air pressure surrounding the connector assembly. Accordingly, the initial moisture and dust seal between the interference fit of the elbow cuff and the bushing insert are preserved and, upon a disassembly operation of the power cable elbow connector 2 from the bushing insert 4, the cavity formed therebetween is vented.

Figure 4:
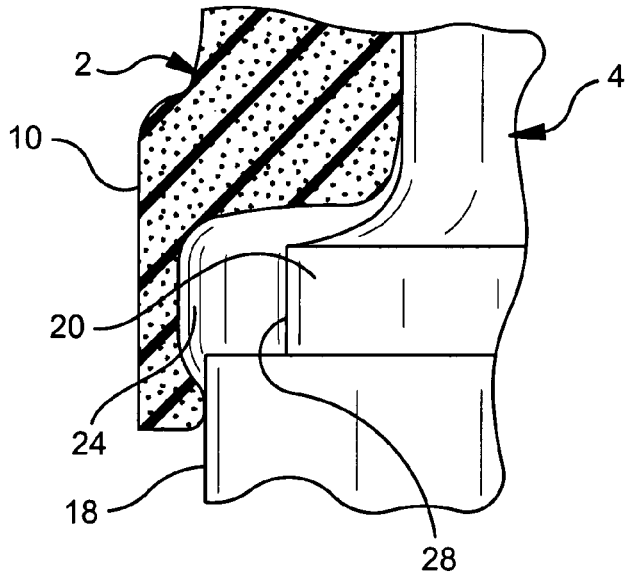
FIG. 4 is an enlarged cross-sectional view of the mating interface between the power cable elbow connector and a modified loadbreak bushing insert including a circumferential vent groove formed in accordance with the present invention.
Figure 5:
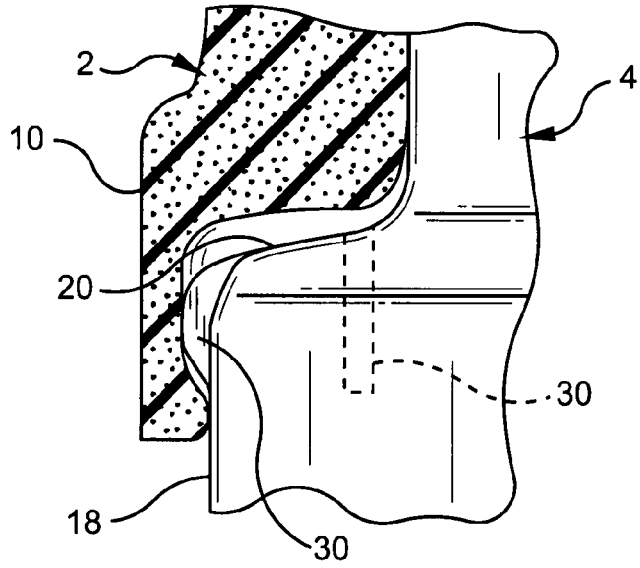
FIG. 5 is an enlarged cross-sectional view of the mating interface between the power cable elbow connector and a modified loadbreak bushing insert including raised ribs formed in accordance with the present invention.
Figure 6:
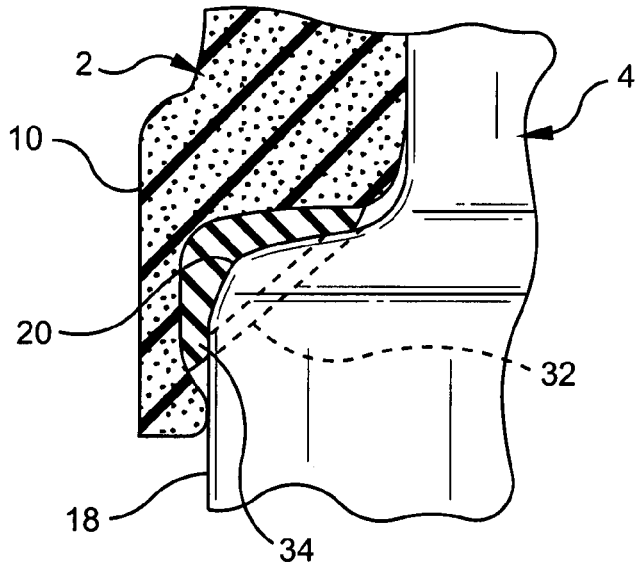
FIG. 6 is an enlarged cross-sectional view of the mating interface between the power cable elbow connector and a modified loadbreak bushing insert including through-hole vents or an elastomeric flap formed in accordance with the present invention.

Alternative methods of venting the cavity 24 are illustrated in FIGS. 4, 5 and 6 which are also partial cross-sectional views of the interface between the elbow cuff 10 and the bushing insert. More specifically, FIG. 4 illustrates a bushing insert transition shoulder which is stepped so as to provide a circumferential groove 28 along a top portion of the bushing interface. Upon disassembly, the circumferential groove 28 opens the cavity to outside ambient air pressure preventing a decrease in dielectric strength of the air within the cavity.

FIG. 5 illustrates a further alternative embodiment in which the bushing insert includes at least one rib 30 substantially formed in the transition shoulder portion 20 of the bushing insert. More specifically, the rib 30, upon disassembly, forces the elbow cuff 10 to expand in a radially outward direction thereby allowing the cavity 24 to be in fluid communication with ambient air surrounding the connector assembly. A further alternative embodiment to vent the cavity formed between the elbow cuff and the bushing insert interface illustrated in FIG. 6 includes at least one through hole 32 from a side portion of the bushing insert to the annular top surface of the transition shoulder portion. Upon disassembly operation, the through hole allows the cavity 24 to vent to the outside air preventing a decrease in pressure in the cavity.

Each of the above methods includes modifying the loadbreak bushing insert to allow venting of the cavity formed between the bushing insert and the elbow cuff. Alternatively, the power cable elbow connector 2 may be modified to prevent a decrease in air pressure in the cavity. It is advantageous to maintain the moisture and dust seal at the elbow cuff and bushing insert interface. Accordingly, although removal of the elbow cuff would prevent any pressure build-up in the cavity, this would also allow moisture and dust to accumulate at the base of the interface and may lead to a flashover situation. A viable solution, as illustrated in FIG. 6, would be to eliminate the through hole vent 32 in the bushing insert and place within the cavity an elastomeric material 34 which would effectively eliminate the cavity and expand upon the disassembly operation. Naturally, the elastomeric material would be designed to fill the cavity but not place undue force at the bushing insert interface so that the power cable elbow connector does not back-off the interface when assembled. A suitable elastomeric material may consist of rubber. The elastomeric material may be in the form of a solid material or a flap which extends from the downward leg of the elbow cuff to the horizontal leg of the cuff.

Figure 7:
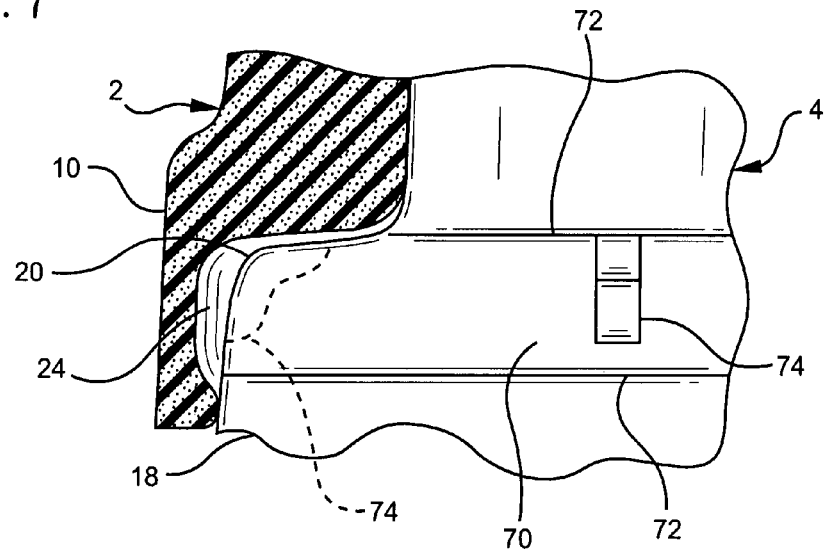
FIG. 7 is an enlarged cross-sectional view of the mating interface between the power cable elbow connector and a modified loadbreak bushing insert including a seating indicator band having vent grooves formed in accordance with the present invention.
Figure 8:
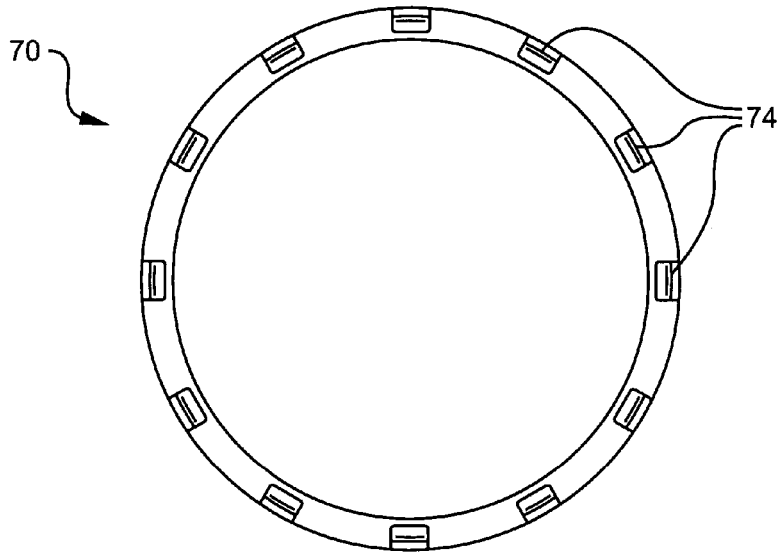
FIG. 8 is a top plan view of a seating indicator band having vent grooves formed in accordance with the present invention.

Referring now to FIGS. 7 and 8, in a further embodiment of the present invention, the venting means are provided on an elbow seating indicator band 70 which is formed on the transition shoulder portion 20 of the bushing insert mid-section 18. The indicator band 70 is an annular ring, having a bright color, such as red, yellow or the like so as to contrast the color of the bushing insert. The indicator band 70 may be molded or extruded from any suitable rubber or plastic material. The transition shoulder portion 20 is formed with a step or recess 72 and the indicator band is mounted in the step or recess. The band 70 is seated on the transition shoulder portion 20 of the bushing insert mid-section 18 such that when the loadbreak connector is properly assembled, the elbow cuff 10 completely obscures the band from sight providing visual indication of proper assembly. If the loadbreak bushing is not fully inserted within the elbow cuff 10, the bright color of the indicator band 70 is visible bringing attention to the improper assembly. An elbow seating indicator band of this type is disclosed in commonly owned U.S. Pat. No. 5,795,180, the disclosure of which is incorporated herein by reference. However, the indicator band of the present invention includes a venting means, such as a plurality of vent grooves 74, formed in spaced relation around the circumference of the band 70. Similar to the venting means described above, upon movement of the elbow cuff 10 away from the bushing insert during disassembly, the lower portion of the vent grooves 74 is exposed to ambient air pressure creating fluid communication with the cavity 24 and equalizing the pressure within the cavity with that of the ambient air pressure surrounding the connector assembly. While the indicator band 70 of FIGS. 7 and 8 is shown with venting grooves 74, any of the other venting means as described above with respect to the transition shoulder portion, i.e., circumferential groove, raised ribs, venting through holes or an elastomeric flap may be provided on the indicator band 70.

Figure 9:
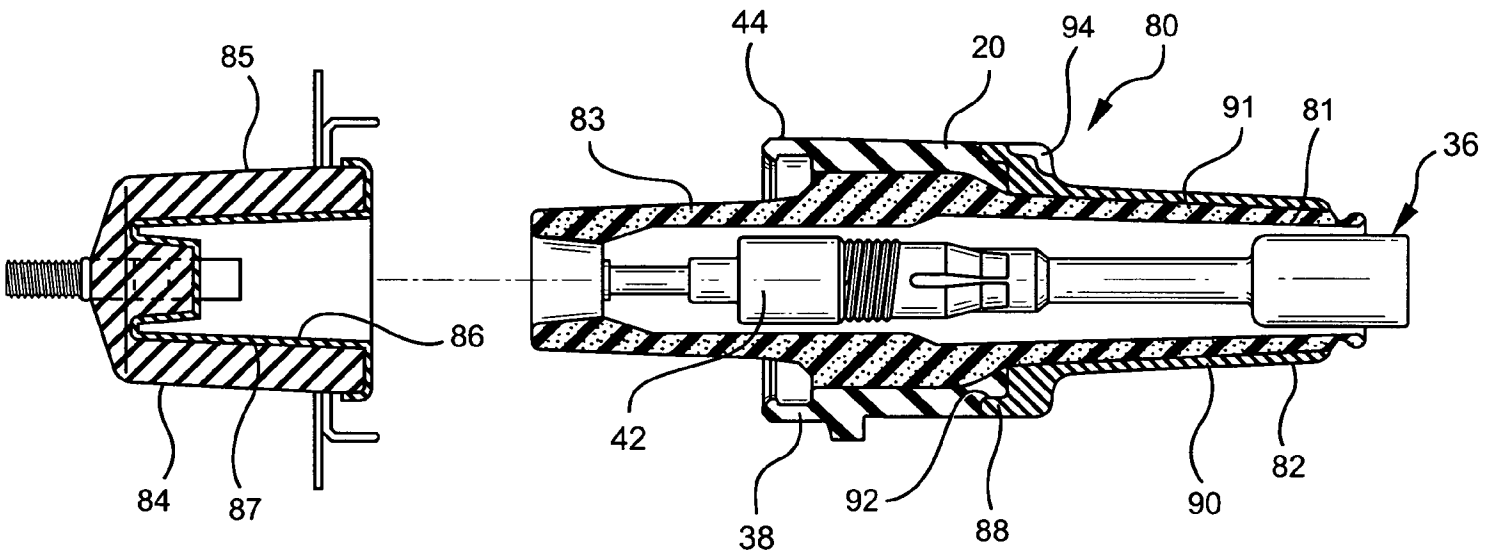
FIG. 9 is a cross-sectional view of a universal bushing well including a bushing well interface shell and a loadbreak bushing insert including a bushing interface shell formed in accordance with the present invention.

FIG. 9 shows still another embodiment of a loadbreak bushing insert 80, including a molded bushing interface shell 82, formed in accordance with the present invention. While the separable electrical connector shown in FIG. 9 is a loadbreak bushing insert, the separately molded interface shell of the present invention can be utilized on interface surfaces of all types of separable electrical connectors to reduce the frictional forces encountered upon assembling and disassembling mating connectors. Thus, the present invention has particular application on such separable electrical connectors as loadbreak connectors and deadbreak connectors. However, the invention is not limited to these particular embodiments. It is within the scope of the present invention to use a low coefficient of friction sleeve on any type of separable electrical connector system, wherein frictional forces are encountered upon assembly and disassembly.

Figure 10:
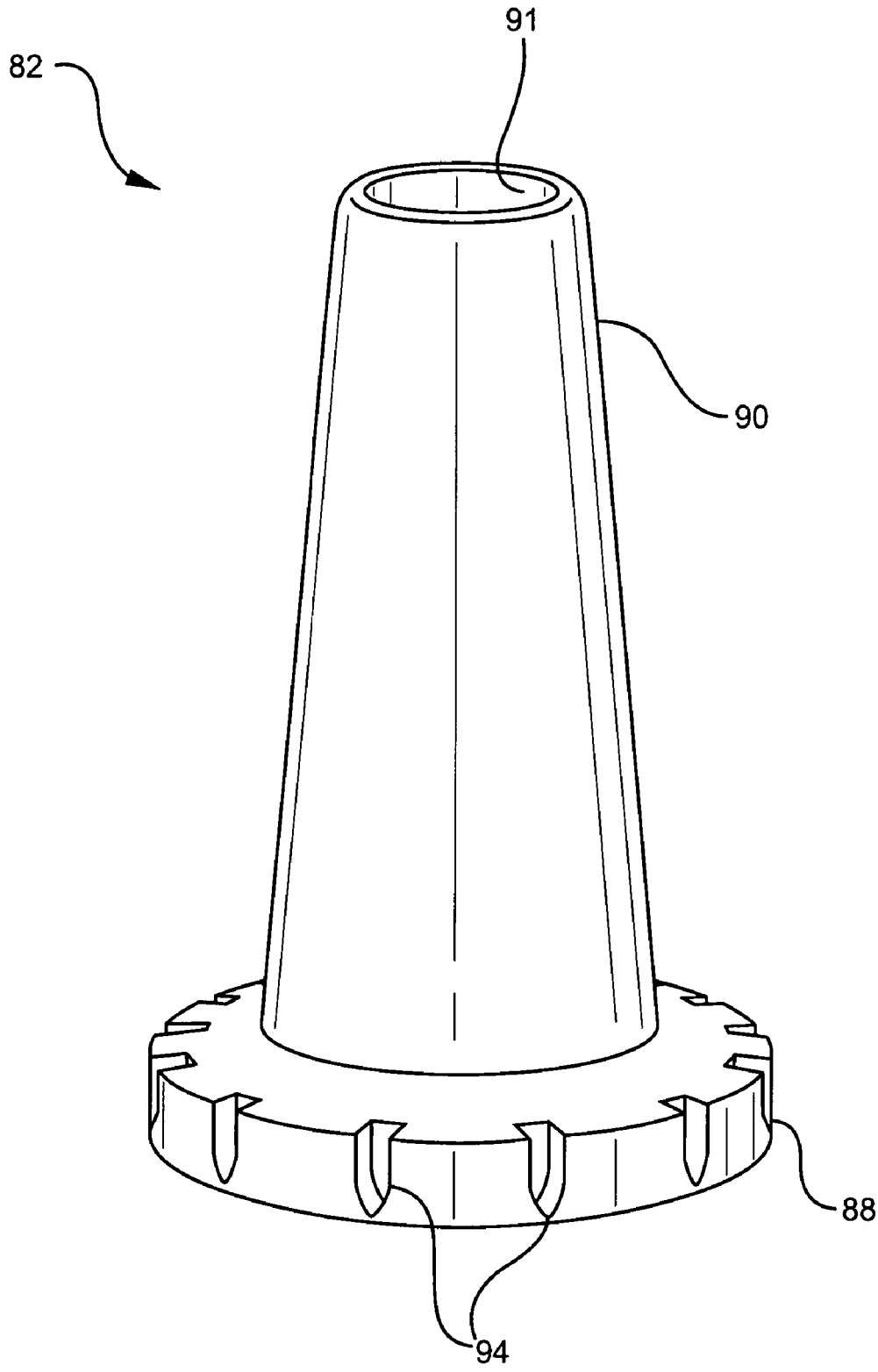
FIG. 10 is a top perspective view of a loadbreak bushing interface shell formed in accordance with the present invention.

Referring additionally to FIG. 10, the shell 82 is molded from any low coefficient of friction plastic material, such as glass-filled nylon, and is disposed on the conical upper (second) end section 81 of the loadbreak bushing insert 80 to reduce frictional forces between the interface surfaces of the insert 80 and the elbow connector 2 upon insertion and removal of the insert into and from the elbow connector. The separately molded shell 82 may be formed, for example, by injection molding, blow molding or spin molding. The shell 82 may be bonded to the conical upper end section 81 of the insert 80 with a suitable adhesive after both parts are molded. However, in a preferred embodiment as discussed further below, the insulative material of the connector housing is molded or extruded directly into a premolded shell placed within the housing mold. Depending on the chosen plastic material of the shell, it may be necessary to apply an adhesion promoter, such as bonding paint, to the inner surface of the interface shell 82 prior to bonding the shell to the housing or prior to molding.

The bushing interface shell 82 may simply include a conical sleeve portion 90, which is sized and shaped to fit over at least a substantial portion of an interface surface of a separable electrical connector, such as the conical upper (second) end section 81 of the loadbreak bushing insert 80. The sleeve portion 90 is a tubular thin walled member having an inner surface 91 designed to be in direct contact with the interface surface of the connector. In the case of a loadbreak bushing insert as shown in FIG. 9, the inner surface 91 of the sleeve portion 90 is designed to be in direct contact with the outer surface of the upper end section 81 of the insert 80. In this embodiment, the upper end section 81 of the insert 80 must be sized to take into consideration the wall thickness of the sleeve portion 90 so that the insert can be inserted into an existing elbow connector 2.

In a preferred embodiment, the bushing interface shell 82 further includes a band portion 88, which may be formed separately from the sleeve portion 90, but is preferably integral with the sleeve portion. Thus, the band portion 88 with integral sleeve 90 forms the bushing interface shell 82, which is disposed over the portion of the separable electrical connector (e.g., the loadbreak bushing insert 80) that interfaces with a mating second connector (e.g., the power cable elbow connector 2). The band portion 88 is similar in size and shape to the indicator band 70 described above in that it is an annular ring disposed over the transition shoulder portion 20 of the bushing insert 80. Again, the transition shoulder portion 20 of the insert 80 is preferably formed with a step or recess 92 and the band portion 88 of the bushing interface shell 82 is mounted in the step or recess. The band portion 88 is seated on the transition shoulder portion 20 of the bushing insert 80 such that when the loadbreak or deadbreak connector is properly assembled, the elbow cuff 10 completely obscures the band portion from sight providing visual indication of proper assembly. If the loadbreak bushing 80 is not fully inserted within the elbow cuff 10, the band portion 88 is visible bringing attention to the improper assembly.

In this regard, like the indicator band 70 described above, at least the band portion 88 of the shell 82 is preferably molded from a brightly colored material so as to starkly contrast the color of the bushing insert 80, thus providing clear and apparent visual indication of proper assembly. The color of the shell 82 may also be selected to indicate the operating voltage of the insert 80. For example, red may be selected to identify a connector or an insert 80 having a voltage class of 15 kV, while blue is selected for 25 kV, yellow for 35 kV, etc. Additionally, the band portion 88 of the shell 82 may be provided with a first contrasting color to provide visual indication of proper assembly and the sleeve portion 90 may be provided with a second contrasting color to indicate the operating voltage of the insert 80. Thus, the contrasting color or colors of the shell 82 will not only provide a visual indication of proper assembly of separable electrical connectors, such as the insert 80 within an elbow connector 2, but it will also identify the voltage class of the connector.

Also, like the indicator band 70 described above, the band portion 88 of the bushing interface shell 82 of the present invention preferably includes a venting means, such as a plurality of vent grooves 94, formed in spaced relation around the circumference of the band portion 88. Similar to all the venting means described above, upon movement of the elbow cuff 10 away from the bushing insert 80 during disassembly, the lower portion of the vent grooves 94 is exposed to ambient air pressure creating fluid communication with the cavity 24 formed between the insert and the power cable elbow. Thus, pressure within the cavity is equalized with that of the ambient air pressure surrounding the connector assembly. Again, while the band portion 88 of FIGS. 9 and 10 is shown with venting grooves 94, any of the other venting means as described above, i.e., a circumferential groove, ribs, venting through holes, an elastomeric flap or any other vent configuration to provide a venting function may be provided on the band portion 88.

Also shown in FIG. 9 is an embodiment of a universal bushing well 84 including a well housing 85 and a bushing well interface shell 86 disposed within the well housing. Like the bushing interface shell 82, the bushing well interface shell 86 is made from a low coefficient of friction plastic material to reduce the frictional forces between the lower (first) end section 83 of the insert and the bushing well 84 upon insertion of the insert into the well. The plastic shell 86 is cup-shaped and fitted on an interior interface surface 87 of the well housing 85 to receive the lower (first) end section 83 of the loadbreak bushing insert 80. Clearance for the well's electrical components is provided in the shell 86 to ensure electrical connection with the insert 80. Thus, the bushing well interface shell 86 not only reduces frictional forces within the bushing well 84, but the shell also improves the mechanical strength of the well.

It has also been found that the method, according to the present invention, of molding a rubber or epoxy insulation compound for an electrical connector housing directly within a previously molded thermoplastic or nylon shell 82 or 86 provides considerable manufacturing benefits. As specifically shown in FIG. 11, by first separately molding a plastic shell 82 in a plastic mold and then placing the plastic shell within a rubber mold 100, wherein the rubber housing is molded, several significant benefits can be achieved.

First, at the critical electrical interface surface at the conical upper end 81 of the connector, the rubber material only comes into contact with the inner surface 91 of the plastic shell 82, as opposed to the cavity surfaces 102 of the mold 100. Isolating the insulation material from the mold cavity in this area eliminates the possibility of contaminants from the mold surfaces being transferred to the critical electrical interface surfaces of the connector, which typically results in a scrapped part.

Second, the premolded shell 82 placed within the rubber mold 100 prevents excess flashing and eliminates mold parting lines at the critical electrical interface surfaces of the connector. The rubber or epoxy material typically used to mold such electrical connectors tends to seep freely within the mold during the injection molding process regardless of the precision used in fabricating the mold. Thus, once cured after molding, the electrical connector housing must be removed from the mold and carefully trimmed of all rubber or epoxy flash. Aside from the time consuming and labor intensive process of trimming the excess flash, there is also the drawback of marring or disrupting the surface of the housing, which could result in electrical failure at high voltage. Moreover, even with the utmost care in removing the flash, mold parting lines may be left on the housing. By injection molding the rubber or epoxy material within the preformed plastic shell, these drawbacks are eliminated since the shell prevents the molding material from seeping and forming flash. The shell of the present invention further acts as a barrier against the formation of mold parting lines on the housing surface in the area of the shell, which may result in an electrical short.

Third, the premolded plastic shell 82 further enhances the lifetime and cleanliness of the rubber mold 100. With conventional rubber and epoxy molding of high voltage connectors, the injected material comes in direct contact with the mold surfaces. To prevent the rubber or epoxy from sticking to the mold, release agents are often applied to the mold cavities. Aside from the possibility of the release agents contaminating the finished molded part, these release agents can be abrasive and cause wear on the mold cavity surfaces. Moreover, despite the application of the release agent, the molded material, which is also abrasive, still often sticks to the mold which may result in voids or other irregularities being formed on the housing surface when the housing is removed from the mold. These voids and irregularities must then be patched to preserve the part. Additionally, the rubber and epoxy remnants, as well as the other gaseous by-products of the curing process, deposited on the mold surfaces require the mold to be cleaned regularly. The method according to the present invention minimizes mold cleaning and its associated costs and down time in manufacturing, as well as prolongs the life of the mold, by isolating the molding material from the mold surfaces.

Figure 11:
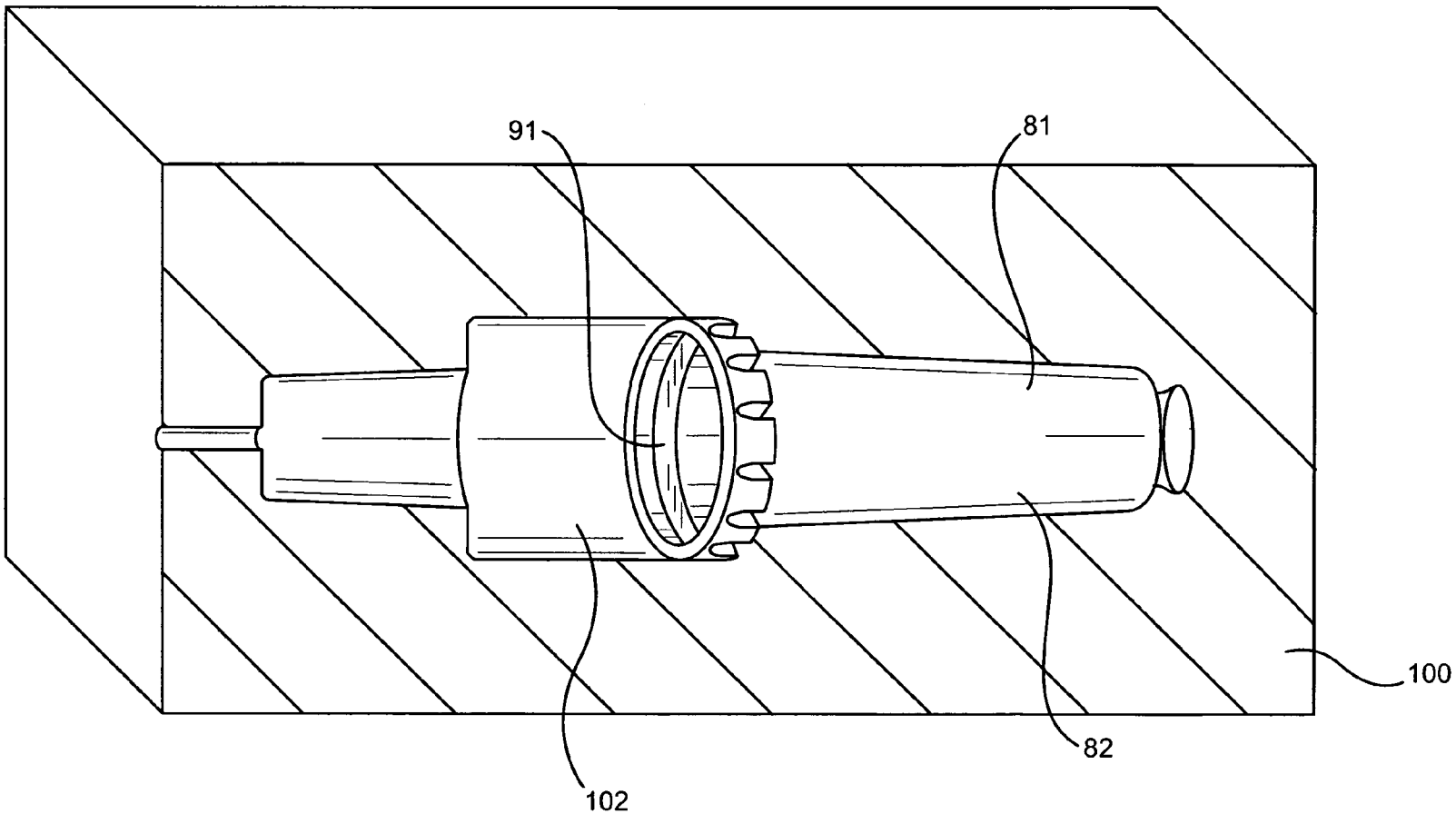
FIG. 11 is a side perspective view of a mold-half used for forming a separable electrical connector in accordance with the present invention.

As previously mentioned, yet another alternative to preventing flashover upon disconnection of a power cable elbow connector from a loadbreak bushing entails increasing the distance between the energized electrode and the ground of the bushing insert. Referring now to FIG. 11, which is a cross-sectional view of a loadbreak bushing insert 4 and universal bushing well 6, the distance to ground from the probe insertion end 36 to the ground electrode 38 is increased by adding an additional insulating layer 40*a* around a substantial portion of the ground electrode 38. The loadbreak bushing insert 4 includes a current carrying path 42 and a flange 44 for coupling the bushing insert to the bushing well 6. In the prior art devices, the ground electrode 38 extends substantially over the entire length of the mid-section 18 of the bushing insert. Accordingly, the distance from the ground electrode of the insert to the energized probe electrode essentially comprises the distance from the transition shoulder portion of the bushing insert to the probe insertion end 36.

The present invention increases this flashover distance from the energized electrode to the ground electrode by placing an insulating layer 40*a* over a substantial portion of the ground electrode. Accordingly, the flashover distance is increased from the transition shoulder portion 20 to approximately the grounding eye 46 of the ground electrode 38. The grounding eye 46 provides for convenient attachment of a ground conductor. A suitable material for the insulation portion 40 and 40*a* of the loadbreak bushing insert is a peroxide-cured, synthetic rubber known and referred to in the art as EPDM insulation. Furthermore, the ground electrode 38 may be formed from a molded conductive EPDM.

Figure 12:
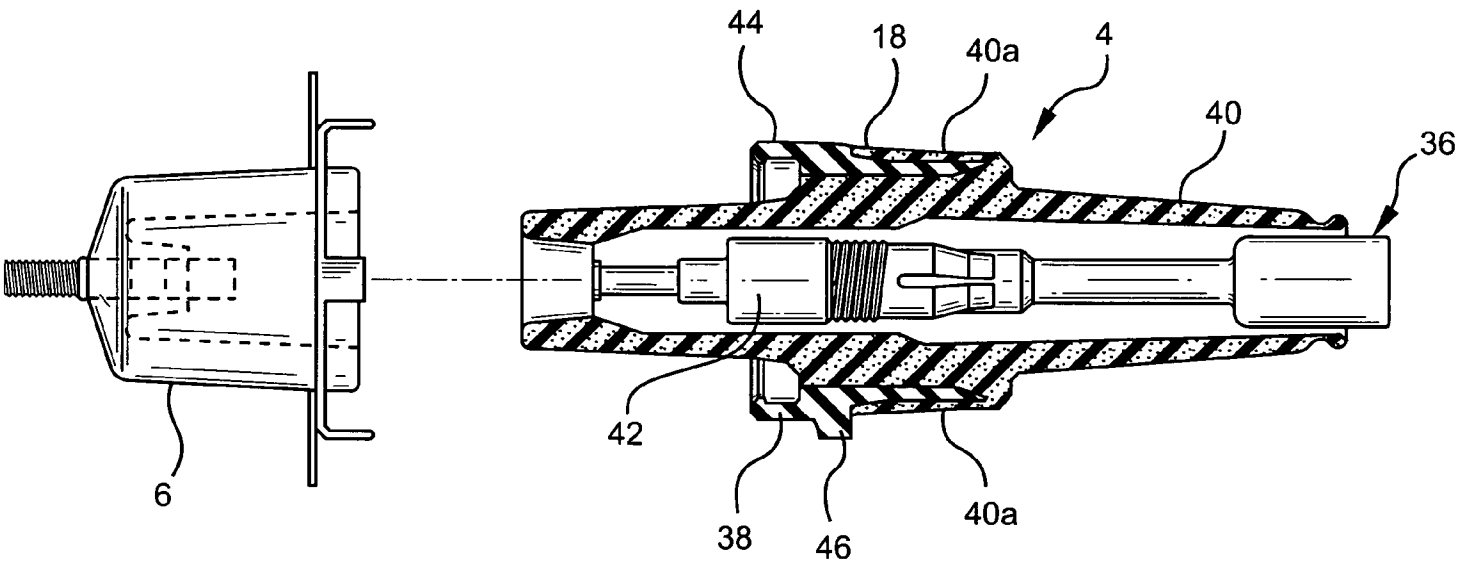
FIG. 12 is a cross-sectional view of a universal bushing well and a loadbreak bushing insert including an insulation material covering a substantial portion of the ground electrode formed in accordance with the present invention.
Figure 13:
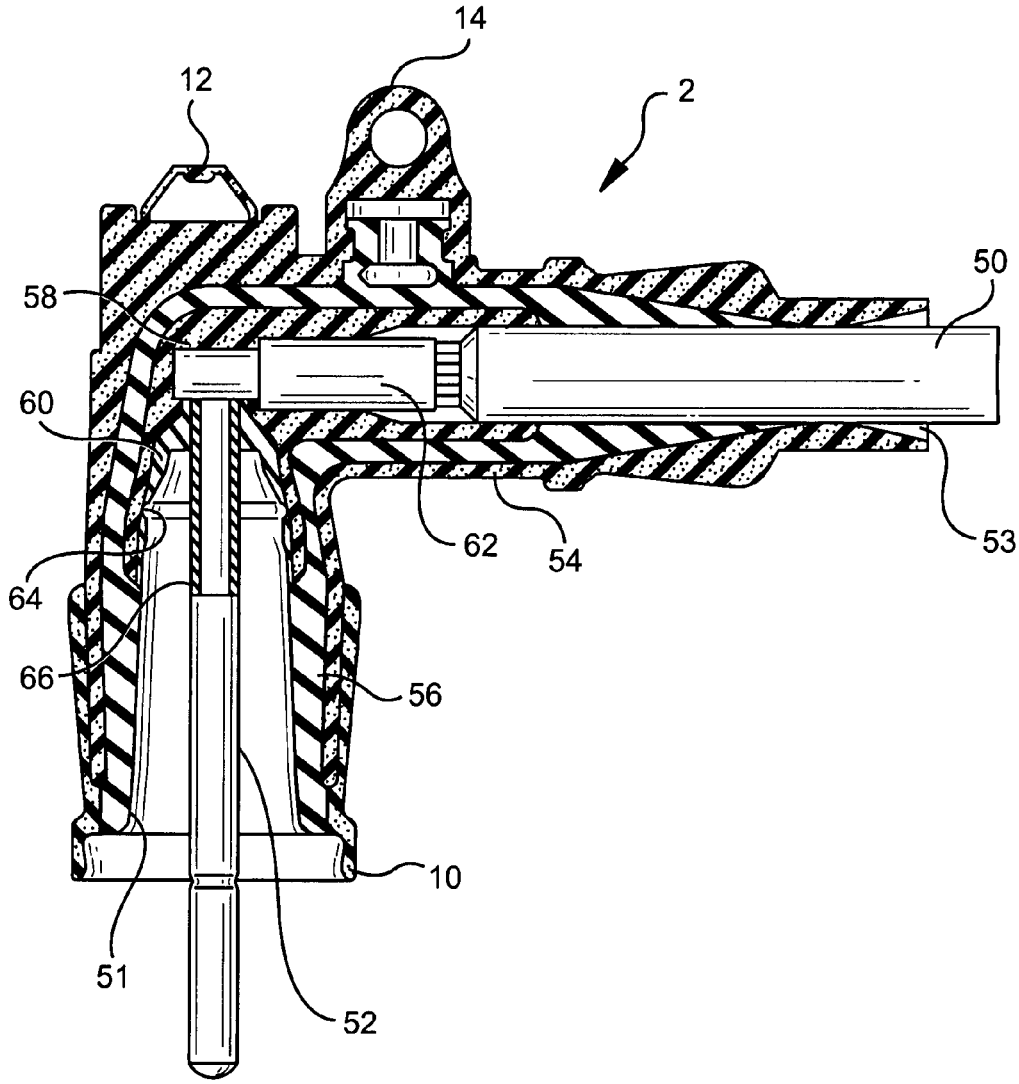
FIG. 13 is a cross-sectional view of a modified power cable elbow connector including an electrode having an insulative coating and an insulation material within the conductive insert of an upper portion of the loadbreak bushing receiving space.

Alternatively, the power cable elbow connector 2 may be modified from the prior art elbows to increase the distance between the energized electrode and ground. FIG. 12 is a cross-sectional view of a modified power cable elbow in accordance with the present invention. The power cable elbow connector 2 includes a conductor receiving end 53 having a conductor 50 therein. The other end of the power cable elbow is a loadbreak bushing insert receiving end having a probe or energized electrode 52 positioned within a central opening of the bushing receiving end. The probe 52 is connected via a cable connector 62 to the cable 50. The power cable elbow includes a shield 54 formed from conductive EPDM. Within the shield 54, the power cable elbow comprises an insulative inner housing 56 which defines the bushing insert receiving opening 51.

In prior art devices, the power cable elbow connector includes a conductive insert which surrounds the connection portion 62 of the cable and an upper portion of the bushing insert receiving space. In order to increase the distance between the energized electrode or probe 52 and ground which is located on the bushing insert and positioned near the elbow cuff 10, the present invention adds an insulating layer placed over portions of the energized electrode. In a first embodiment, insulating portion 60 is provided in the upper end of the bushing insert receiving opening within the conductive insert 58. The insulating portion 60 extends from a compression lug 62 for receiving the cable 50 to a position below the locking ring 64 which engages a bushing insert locking groove to secure connection of the bushing insert within the power cable elbow connector. Accordingly, in order for flashover to occur, the arc would have to extend over the insulating layer 60 and further over insulating layer 56 to reach the ground electrode of the bushing insert.

Alternatively, the distance between the energized electrode 52 and the ground electrode 38 of the bushing insert may be further increased by covering a portion of the energized electrode or probe 52 to increase the flashover distance. As illustrated in FIG. 12, the probe 52 includes an upper portion having an insulating layer 66 surrounding the upper portion thereof. Accordingly, in order for a flashover to occur, the arc must first traverse the insulating material 66 surrounding the upper portion of the electrode 52, then traverse the upper insulating portion 60 within the conductive insert 58 and the insulating material 56 to reach the ground electrode 38 on the bushing insert. Thus, the flashover distance is increased by the distance that the insulating material covers the electrode and further by the distance from the top of the bushing insert receiving opening to the bottom portion of the conductive insert which, in the prior art, was a conductive path. Naturally, the power cable elbow connector may be modified with either the probe insulation 66, the insulation material 60 within the conductive insert or both in combination to increase the distance between the energized electrode and ground. By increasing the flashover distance, the likelihood of flashover due to a decrease in air pressure around the sealed interface between the power cable elbow connector 2 and loadbreak bushing insert 4 due to a decrease in dielectric strength of the air around the interface is significantly decreased.

The loadbreak connector assembly of the present invention including the modified bushing insert and modified power cable elbow connector greatly reduces the likelihood of flashover upon disassembly operation. Flashover is prevented by either providing venting means at the interference fit interface between the bushing insert and the power cable elbow connector or increasing the flashover distance that an arc has to travel to ground in order to prevent flashover. The increase in flashover distance is accomplished by providing additional insulating material on either the energized electrode, within the conductive insert or both.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A high voltage loadbreak bushing insert including an insulative housing having an axial bore therethrough and a conductive member disposed within said axial bore, wherein said insulative housing comprises:

a first end section being dimensioned to be seated in a bushing well, a second end section opposite said first end section, said second end section being dimensioned for insertion into a power cable elbow connector; and a mid-section disposed between said first and second end sections, said mid-section being radially larger than said first and second end sections and being dimensioned to be sealed against an elbow cuff of the power cable elbow connector; and a transition shoulder portion disposed between said second end section and said mid-section, said transition shoulder portion including at least one raised venting portion protruding radially outwardly from said transition shoulder portion, said raised venting portion being adapted to force the elbow cuff of the power cable elbow connector to expand in a radially outward direction upon withdrawal of said second end section from said power cable elbow connector, thereby venting a cavity formed between said bushing insert and the power cable elbow connector.

2. A bushing insert as defined in claim 1, wherein said transition shoulder portion includes a plurality of raised venting portions circumferentially spaced along said transition shoulder portion.

3. A bushing insert as defined in claim 1, wherein said raised venting portion comprises a rib.

4. A bushing insert as defined in claim 1, wherein said transition shoulder portion further comprises an inclined portion, said raised venting portion protruding radially outwardly from said inclined portion.

5. A bushing insert as defined in claim 1, wherein said transition shoulder portion comprises an indicator band formed of a different colored material than the insulative housing.

6. A bushing insert as defined in claim 1, wherein said transition shoulder portion comprises an interface shell molded from a low coefficient of friction plastic and having a sleeve portion provided on at least a portion of said second end section.

7. A bushing insert as defined in claim 1, wherein said insert is rated between 15 kV and 25 kV.

8. A high voltage loadbreak bushing insert including an insulative housing having an axial bore therethrough and a conductive member disposed within said axial bore, wherein said insulative housing comprises:

a first end section being dimensioned to be seated in a bushing well, a second end section opposite said first end section, said second end section being dimensioned for insertion into a power cable elbow connector; and a mid-section disposed between said first and second end sections, said mid-section being radially larger than said first and second end sections and being dimensioned to be sealed against an elbow cuff of the power cable elbow connector; and a transition shoulder portion disposed between said second end section and said mid-section, said transition shoulder portion including an inclined venting portion tapering radially inward from said mid-section toward said second end section said inclined venting portion being exposed to ambient air pressure upon withdrawal of said second end section from said power cable elbow connector, thereby venting a cavity formed between said bushing insert and the power cable elbow connector.

9. A bushing insert as defined in claim 8, wherein said transition shoulder portion includes a plurality of inclined venting portions circumferentially spaced along said transition shoulder portion.

10. A bushing insert as defined in claim 8, wherein said transition shoulder portion further comprises at least one raised portion protruding radially outwardly from said inclined venting portion.

11. A bushing insert as defined in claim 10, wherein said raised portion comprises a rib.

12. A bushing insert as defined in claim 8, wherein said transition shoulder portion comprises an indicator band formed of a different colored material than the insulative housing.

13. A bushing insert as defined in claim 8, wherein said transition shoulder portion comprises an interface shell molded from a low coefficient of friction plastic and having a sleeve portion provided on at least a portion of said second end section.

14. A bushing insert as defined in claim 8, wherein said insert is rated between 15 kV and 25 kV.

* * * * *